US006162275A

United States Patent [19]

Jonsson et al.

[11] Patent Number: 6,162,275

[45] Date of Patent: Dec. 19, 2000

[54] STEEL AND A HEAT TREATED TOOL THEREOF MANUFACTURED BY AN INTEGRATED POWDER METALURGICAL PROCESS AND USE OF THE STEEL FOR TOOLS

[75] Inventors: Karin Jonsson, Stocksund; Henry Wisell; Leif Westin, both of Söderfors, all of Sweden

[73] Assignee: Erasteel Kloster Aktiebolag, Sweden

[21] Appl. No.: 09/331,117

[22] PCT Filed: Feb. 25, 1998

[86] PCT No.: PCT/SE98/00334

§ 371 Date: Jun. 17, 1999

§ 102(e) Date: Jun. 17, 1999

[87] PCT Pub. No.: WO98/40180

PCT Pub. Date: Sep. 17, 1998

[30] Foreign Application Priority Data

Mar. 11, 1997 [SE] Sweden ..... 9700862

[51] Int. Cl.[7] ..... C22C 33/02

[52] U.S. Cl. ..... 75/238; 75/236; 75/244; 75/246; 419/11; 419/29; 419/49

[58] Field of Search ..... 75/236, 244, 238, 75/246; 419/11, 49, 29

[56] References Cited

U.S. PATENT DOCUMENTS 3,809,541 5/1974 Steven .
5,435,827 7/1995 Wisell .
5,522,914 6/1996 Stasko et al. .
5,525,140 6/1996 Wisell .
5,578,773 11/1996 Wisell .

FOREIGN PATENT DOCUMENTS

88/07093 10/1988 WIPO ..... C22C 33/02
93/02818 2/1993 WIPO ..... C22C 33/02
93/02819 A1 2/1993 WIPO ..... C22C 33/02

*Primary Examiner*—Ngoclan Mai
*Attorney, Agent, or Firm*—Kilpatrick Stockton LLP

[57] ABSTRACT

The invention relates to a steel having the following alloy composition in weight-%: 1.4–1.6 (C+N), max. 0.6 Mn, max. 1.2 Si, 3.5–4.3 Cr, 1.5–3 Mo, 1.5–3 W, wherein $6<W_{eq}<9$, and $W_{eq}$=% W+2×% Mo, 3.5–4.5 V, max. 0.3 S, max. 0.3 Cu, max. 1 Co, a total amount of max. 1.0 of Nb+Ta+Ti+Zr+Al, a total amount of 0.5 of other elements, including impurities and accessory elements in normal amounts, balance iron, and with a microstructure substantially consisting of a martensitic matrix and in the matrix 2–15, preferably 5–10 volume-% undissolved hard products having the particle size 0.1–3 $\mu$m, said hard products being of MX-type, where M is V and X is C and/or N, wherein 40–60% of the C and N content of the alloy is bound to vanadium as carbides and/or as carbo-nitrides, and a functional amount of hard products precipitated in the martensitic matrix after solution heat treatment of the steel at a temperature between 1000 and 1225° C. and tempering at least twice for at least 0.5 h at a temperature between 190 and 580° C., and the use of the steel for tools for forming and/or cutting operations.

15 Claims, 4 Drawing Sheets

STEEL AND A HEAT TREATED TOOL THEREOF MANUFACTURED BY AN INTEGRATED POWDER METALURGICAL PROCESS AND USE OF THE STEEL FOR TOOLS

TECHNICAL FIELD

The invention relates to a powder-metallurgically manufactured steel for tools, particularly for so called cold work tools, for forming and/or cutting operations. The invention also relates to the tool that is made of the steel and which has attained specific, desired features through a heat treatment which has been adapted the alloy composition and to the powder-metallurgical manufacturing technique. The invention also relates to the integrated process for the manufacturing of the steel, the tool, and the heat treatment of the tool, wherein the expression "integrated" shall mean that the powder-metallurgical manufacturing technique as well as the heat treatment of the tool contribute to the achievement of the desired combination of features of the finished tool.

BACKGROUND OF THE INVENTION

Steels of the type indicated in the preamble usually are referred to as cold work steels. Dies for cold extrusion of metals; deep drawing and powder pressing counter dies; knives and other tools for shearing and cutting, etc., are typical applications of cold work steels. A powder-metallurgically manufactured high speed steel having the composition 1.28 C, about 0.3 Si, about 0.5 Mn, 4.2 Cr, 5.0 Mo, 6.4 W, 3.1 V, balance Fe and impurities, is a well known steel for this type of applications. A drawback of this steel is that it does not have a toughness that satisfies highest demands. Another powder-metallurgically manufactured steel known in the art has the composition 1.5C, 1.0 Si, 0.4 Mn, 8.0 Cr, 1.5 Mo, 4.0 V, balance Fe and impurities. This steel also after tempering has a comparatively high content of rest austenite, which is attributed to the high chromium content, which reduces the hardness. Therefore it is a long felt demand of a material which combines the best features of the said steels. More particularly, this can be expressed such that there is a demand of a steel which affords optimal features as far as toughness, wear resistance and hardness for the intended field of use are concerned at the same time as the total content of alloy elements, and particularly the most exclusive alloy elements, are kept at a comparatively low level in order to make the material favourable also from a cost point of view.

BRIEF DISCLOSURE OF THE INVENTION

It is the purpose of the invention to satisfy the above mentioned demands. This can be achieved therein that the invention is characterized by what is stated in the appending claims. Without binding the invention to any specific theory, the importance of the various alloy elements and the various structure constituents for the achievement of the desired combination of features shall be explained more in detail. As far as percentages are concerned, alloy contents are always measured in weigh-% and structure constituents in volume-% if not anything else is stated.

Carbon and nitrogen

Carbon and nitrogen shall exist in an amount of at least 1.4% and not more than 1.6%, preferably at least 1.44% and not more than 1.56%; typically 1.5%. Normally, the nitrogen content amounts to not more than 0.1%, but the powder-metallurgical manufacturing technique makes it possible to dissolve as much as about 1% nitrogen, if the carbon content is so low that the total amount of carbon and nitrogen is 1.4–1.6%. A variant of the steel therefore is characterized in that the steel contains a high content of nitrogen, max. 1.0%, e.g. 0.3–1.0% N, which can be achieved through solid phase nitriding of produced powder, wherein the nitrogen can replace carbon in those hard components which shall exist in the steel in the final tool. Thus 40–60% of the carbon 20 and the nitrogen shall be included in undissolved hard components of MX-type, i.e. primary carbides or carbo-nitrides, where M is substantially vanadium and X is carbon and/or nitrogen, while the rest essentially is dissolved in the matrix or is present as precipitated hard components. Lower contents than 1.4% carbon +nitrogen do not afford sufficient hardness and wear resistance, while higher contents than 1.6% can cause embrittlement problems.

Manganese

Manganese is present in amounts which are normal for these types of steel, i.e. from at least 0.1% up to not more than about 0.6%. The typical manganese content is about 0.3%.

Silicon

Silicon is present in an amount of at least 0.1% and can exist in amounts up to about 1% or not more than 1.2% in a silicon alloyed variant, but normally the steel does not contain more than 0.6% silicon or typically about 0.5% silicon.

Sulphur

Sulphur normally is not present more than as an impurity in the steel, i.e. in an amount not more than 0.03%. In order to improve the cutability of the steel, however, up to 0.3 sulphur can be added in a sulphur alloyed variant. In this case, the steel contains 0.1–0.3% sulphur.

Chromium

Chromium shall be present in an amount of at least 3.5% in order to afford a sufficient hardness to the steel. The content of chromium, however, must not exceed 4.3%. If the chromium content is higher, there is a risk, especially at comparatively low solution temperatures, that existing chromium carbides in the steel will not be dissolved. The chromium carbides which are concerned in this connection are of $M_7C_3$- and $M_{23}C_6$-type, which are not desired. Moreover, the precipitation of $M_2C$-carbides or corresponding in the martensite which is formed at the cooling from the tempering temperature, which precipitation is desired according to the invention, will be detrimentally influenced by the chromium content when rest austenite is transformed to martensite. At higher chromium contents there is a risk that the rest austenite content will be higher than what is desirable. Not only would this rest austenite have an impact upon the precipitation of $M_2C$-carbides or corresponding but it would also per se be undesired, because it would reduce the hardness which can cause plastic deformation e.g. deformation of sharp corners or edges on the tool when the tool is used.

Molybdenum and tungsten

Each of molybdenum and tungsten shall exist in the steel in an amount of at least 1.5% but not more than 3%. Preferably each of the said elements shall exist in an amount of 1.8–2.8%, suitably 2.1–2.7%, typically 2.5%. However, $W_{eq}$=% W+2×% Mo shall be at least 6 and not more than 9, preferably at least 6.5 and not more than 8.5, suitably at least 7 and not more than 8, typically 7.5. The lowest content of $W_{eq}$ is required in order to obtain a desired precipitation of $M_2C$-carbides or corresponding (nitrides, carbo-nitrides) in connection with the high temperature tempering which shall be described in the following, while the maximal content is chosen in order to avoid the formation of primary $M_6C$- carbides, i.e. W, Mo-carbides which are not desirable according to the invention. By maximizing the total content of molybdenum and tungsten in this way, the content of $M_6C$-carbides and corresponding can be maximized to 2%, preferably max. 1%. As a matter of fact, any detectable $M_6C$-carbides or corresponding are normally not present in the steel of the invention.

Vanadium

Vanadium shall exist in an amount of at least 3.5% in order that the steel shall get a desired wear resistance through a high content of MC-carbides or corresponding carbo-nitrides. The maximum content may amount to 4.5%. The toughness will be too low if the vanadium content is higher.

Other carbide and nitride formers

The steel of the invention does not contain any intentionally added carbide or nitride formers besides the mentioned carbide and nitride formers and iron. The total amount of niobium, tantalum, titanium, zirconium, and aluminium, and possible further strong carbide and/or nitride formers amounts to totally max. 1.0%.

Cobalt

The cobalt is an element which generally increases the steel's hardness. It is not intentionally added to the steel of the invention but can exist as a component in used raw materials and this particularly may be the case when the steel is manufactured in plants having a main production of high speed steels, and can be tolerated in amounts up to max. 1%.

Other elements

The steel of the invention should not contain any further, intentionally added alloy elements. Copper may exist in an amount up to max. 0.3%, tin in an amount up to max. 0.1%, lead up to 0.005%. The total content of these and other elements in the steel, except iron, may amount to max. 0.5%.

Manufacturing and treatment of the steel and its microstructure

A melt having the alloy composition of the invention is prepared. A stream of molten metal is disintegrated to very small droplets by means of an inert gas which can be argon or nitrogen. Nitrogen is particularly used if the steel shall be intentionally alloyed with nitrogen. The droplets are cooled as they fall though the inert gas and solidify to a fine powder. The composition in each individual powder grain will be very homogenous, because segregation do not have time to establish during the course of solidification. In the powder grains, however, there exist precipitated primary MC-carbides, or carbo-nitrides when the powder grains contain a high content of nitrogen. About half the amount or 40–60% of the total content of carbon and nitrogen is collected in the MC-carbides, or corresponding carbo-nitrides, where M is vanadium. These carbides or carbo-nitrides have a particle size which does not exceed 3 $\mu$m, and at least 90% of the total amount of these hard products have sizes in the size range 0.1–3 $\mu$m.

The powder is sieved and charged in metal sheet capsules which are gas evacuated and then sealed, whereupon the capsules with their content first is cold compacted and then subjected to hot isostatic pressing, so called HIP-ing, at a temperature above 900° C., normally in the range 900–1200° C., and at a pressure over 90 MPa, normally in the range 90–150 MPa. The material then is forged and rolled to desired shape and dimension in a conventional way. After finished hot working, the material is soft annealed at a temperature of about 900° C. and is then slowly cooled.

The material is delivered in the soft annealed condition to tool makers of different direction. Tool makers namely is a heterogeneous group of manufacturers. It is in the first place the facilities for the heat treatment of the finished tools that differ very much, which has to do with such factors as the degree of specialisation of the tool makers, the age of the plant, etc.

Basically, there are two main types of plants, namely on one hand plants on which it is possible and conventional to harden the steel from high solution heat treatment temperatures, which means temperatures in the range 1100–1225° C., and on the other hand plants in which the furnaces do not allow higher temperatures than 1000–1100° C. for the solution heat treatment. In the first place high speed steel tool makers belong to the first group, while manufacturers of conventional cold work steel tools belong the latter group. It is a purpose of the invention to satisfy both these categories. According to the broadest aspect of the invention, the manufactured tools are hardened through solution heat treatment at a temperature between 1000 and 1225° C. followed by rapid cooling to below 500° C. in order to prevent formation of pearlite and/or bainite, whereafter the cooling can proceed at a slower rate by cooling in air to room temperature or at least to below 50° C. The material then is tempered at a temperature between 190 and 580° C. at least twice, each time for at least half an hour but normally not for a longer period of time than 4 h in connection with each tempering operation.

The result in terms of the micro-structure of the material and hence also in terms of the mechanical characteristics of the material depends on within which part of the said temperature ranges for the solution heat treatment, and for the tempering, that the tool maker operates. In the first case—the high temperature alternative—it is possible to choose a hardening temperature (solution heat treatment temperature) within a comparatively broad temperature range, usually within the range 1050–1250° C. depending on which hardness of the end product that is desired after tempering. For the tempering operation, however, a more narrow temperature range is applied in order that an aimed secondary hardening effect shall be achieved, namely a temperature between 520 and 580° C. The MC-carbides and/or corresponding carbo-nitrides are only partially but essentially all other carbides and nitrides are completely dissolved during the solution heat treatment. The degree of dissolution of the MC-carbides depends on the solution heat treatment temperature. At the intensified cooling there is formed martensite, which is the dominating constituent of the matrix. In the latter there is 2–15, preferably 5–10 vol-% undissolved MC-carbides or corresponding carbo-nitrides. However, also after the cooling operation there remains a certain amount of rest austenite. The tempering at 520–580° C., normally at 550–560° C. aims at transforming the rest austenite to martensite and to provide precipitations of $M_2C$-carbides and/or corresponding carbo-nitrides in the martensite. In order to secure that essentially all rest austenite is transformed to martensite, the tempering is carried out twice or more times. The precipitated $M_2C$-carbides or corresponding have a size smaller than 100 nm. The typical size lies, according to previously made and published studies, in the size range 5–10 nm. They are in other words sub-microscopic and can therefor not be observed by means of conventional microscopes. They are, however, recognised through the secondary hardening that is achieved by the tempering operation, which secondary hardening is something that is characteristic for this type of precipitation. Therefor it can implicitly be established that $M_2C$-carbides do exist in large amounts in the martensitic matrix of the material of the invention. It is, however, not within the frame of the development work of the invention to quantify the amount of precipitated $M_2C$-carbides, where M can represent any carbide forming metal in the alloy, such as tungsten, molybdenum, chromium, iron and vanadium, but generally speaking can be stated that the number of small $M_2C$-carbides widely exceeds e.g. 1000 carbides/$\mu m^2$. Even if other metals than tungsten and molybdenum are parts of the $M_2C$-carbides, the said elements are essential ingredients. That is one of the reasons why $W_{eq}$ shall be at least 6, preferably at least 6.5 and suitably at least 7% in the steel. Besides undissolved MC-carbides and/or corresponding carbo-nitrides and the secondary precipitated $M_2C$-caribdes and/or carbo-nitrides, the tempered material does not contain any other carbides to any substantial degree. Thus, the material is void of chromium carbides, and $M_6C$-carbides do not either exist in any noticeable degree.

As far as the low temperature alternative is concerned, the solution heat treatment is performed at a temperature between 1000 and 1100° C., while the tempering typically is performed at a temperature between 190 and 250° C., more particularly between 190 and 220° C. The solution heat treatment corresponds to the solution heat treatment at the high temperature alternative, within the lower part of the wider range as mentioned above, which implies that a minor dissolution of the MC-carbides and a substantially total dissolution of all other carbides are achieved. The cooling is carried out in the same mode as according to the foregoing alternative. The tempering is carried out twice or more times for at least half an hour each time. $M_2C$-carbides are not precipitated and nor is there achieved the same pronounced secondary hardening effect at this low temperature tempering. Instead $M_3C$-carbides are precipitated, which substantially consist of cementite. A certain amount of rest austenite, max. 20%, preferably max. 15%, is not transformed to martensite but exists as part of the matrix in the finished tool according to this alternative. This to some degree reduces the hardness of the material, but on the other hand, the amount of remaining, undissolved MC-carbides is greater than after the high temperature tempering, which improves the wear resistance. The alternative which includes the lower solution heat treatment temperature and the lower tempering temperature therefor may be a more advantageous heat treatment for certain types of tools, depending on their field of use, or desirable depending on limited access to furnaces with about 100° C. as highest possible temperature.

BRIEF DESCRIPTION OF DRAWINGS

The invention shall be explained more in detail with reference to performed experiments and achieved results. Herein reference will be made to the accompanying drawings, in which.

DESCRIPTION OF CARRIED OUT EXPERIMENTS

Figure 1:
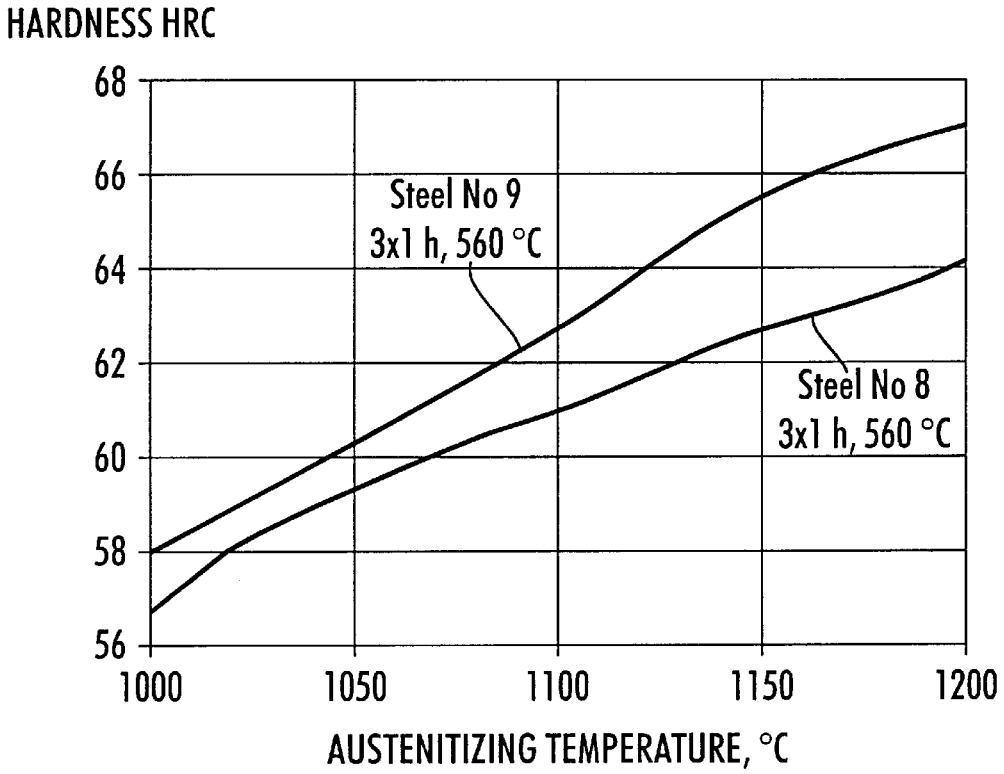
FIG. 1 shows the hardness versus the hardening temperature after high temperature tempering of a steel according to the invention and of a reference material.

In a first series of experiments seven alloy variants were made, steels No. 1–7 in Table 1. Powders were made of the molten alloys according to the technique which has been described in the foregoing brief disclosure of the invention. The powder was filled in small metal sheet capsules, Ø 46 mm, length about 0.5 m. The capsules were closed and gas evacuated, whereafter the capsules with their content were compacted to full density, comprising hot isostatic pressing at a temperature of 1150° C. and a pressure of 100 MPa.

TABLE 1

Composition, weight-%, balance Fe and unavoidable impurities

| | C | | Si | | Mn | Cr | |
|---|---|---|---|---|---|---|---|
| Steel No. | Typical | Analysed | Typical | Analysed | Analysed | Typical | Analysed |
| 1 | 1.1 | 1.09 | 0.5 | 0.49 | n.a. | 4.0 | 3.97 |
| 2 | 1.2 | 1.19 | 0.5 | 0.50 | " | 4.0 | 3.87 |
| 3 | 1.3 | 1.30 | 0.5 | 0.50 | " | 4.0 | 3.99 |
| 4 | 1.4 | 1.42 | 0.5 | 0.53 | " | 4.0 | 3.97 |
| 5 | 1.5 | 1.50 | 0.5 | 0.52 | " | 4.0 | 3.96 |
| 6 | 1.6 | 1.59 | 0.5 | 0.55 | " | 4.0 | 3.99 |
| 7 | 1.3 | 1.29 | 1.0 | 1.02 | " | 4.0 | 4.05 |
| 8 | 1.5 | 1.48 | 0.5 | 0.55 | " | 4.0 | 4.00 |
| 9 | 1.28 | n.a. | ~0.3 | n.a. | ~0.5 | 4.2 | n.a. |
| 10 | 0.8 | " | ~0.4* | " | ~0.4* | 4.0 | " |
| 11 | 1.5 | " | 1.0 | " | 0.4 | 8.0 | " |
| 12 | 0.9 | " | 0.3 | " | 0.3 | 4.2 | " |
| 13 | 1.55 | " | 0.4 | " | 0.4 | 12.0 | " |

| | Mo | | W | | V | | N |
|---|---|---|---|---|---|---|---|
| Steel No. | Typical | Analysed | Typical | Analysed | Typical | Analysed | Analysed |
| 1 | 2.0 | 2.00 | 2.0 | 2.04 | 4.0 | 4.02 | n.a. |
| 2 | 2.0 | 1.99 | 2.0 | 2.06 | 4.0 | 4.00 | " |
| 3 | 2.0 | 1.99 | 2.0 | 2.07 | 4.0 | 3.99 | " |
| 4 | 2.0 | 1.96 | 2.0 | 2.10 | 4.0 | 4.03 | " |

TABLE 1-continued

| Composition, weight-%, balance Fe and unavoidable impurities | | | | | | | |
|---|---|---|---|---|---|---|---|
| 5 | 2.0 | 1.95 | 2.0 | 2.08 | 4.0 | 3.91 | " |
| 6 | 2.0 | 1.97 | 2.0 | 2.13 | 4.0 | 4.04 | " |
| 7 | 2.0 | 2.02 | 2.0 | 2.08 | 4.0 | 4.02 | " |
| 8 | 2.5 | 2.50 | 2.5 | 2.50 | 4.0 | 3.98 | " |
| 9 | 5.0 | n.a. | 6.4 | n.a. | 3.1 | n.a. | " |
| 10 | 3.0 | " | 3.0 | " | 3.0 | " | " |
| 11 | 1.5 | " | — | " | 4.0 | " | " |
| 12 | 5.0 | " | 6.4 | " | 1.8 | " | " |
| 13 | 0.8 | " | — | " | 0.8 | " | " |

*Estimated values
n.a. = not analysed

After the hot isostatic pressing the samples were not subjected to any heat treatment as distinguished from what is normal for full scale production. Instead, each HIP-ed capsule was cut to pieces for heat treatment according to Table 2.

TABLE 2

| Heat treatment schedule | | | | | | | |
|---|---|---|---|---|---|---|---|
| | Solution heat treatment temperature, ° C., at the hardening | | | | | | |
| Tempering | 1000 | 1050 | 1100 | 1150 | 1180 | 1200 | 1220 |
| | ☺ | ☺ | ☺ | ☺ | ☺ | ☺ | ☺ |
| 200° C., 2 × 2 h | ☺ | ☺ | ☺ | ☺ | ☺ | ☺ | ☺ |
| 500° C., 3 × 1 h | | | ☺ | ☺ | ☺ | | |
| 520° C., 3 × 1 h | | | ☺ | ☺ | ☺ | | |
| 540° C., 3 × 1 h | | | ☺ | ☺ | ☺ | | |
| 550° C., 3 × 1 h | | | ☺ | ☺ | ☺ | | |
| 560° C., 3 × 1 h | ☺ | ☺ | ☺ | ☺ | ☺ | ☺ | ☺ |
| 580° C., 3 × 1 h | | | ☺ | ☺ | ☺ | | |
| 600° C., 3 × 1 h | | | ☺ | ☺ | ☺ | | |

Hardness and grain sizes of the hardened and tempered samples were measured. The grain size varied between 7 and 10 $\mu$m for those samples which had been hardened from at the lowest 1150° C. The hardnesses varied depending on the carbon content. By choosing the carbon content 1.5% C there was achieved a maximal hardness of about 64 HRC after tempering. It was, however, estimated that the total amount of molybdenum and tungsten was a little too low in order that secondary hardening should be achieved to a desirable degree through precipitation of $M_2C$-carbides after high temperature treatments at a tempering temperature of about 560° C. which is optimal for such precipitation hardening. Therefor there was produced, for further studies, a heat with the aimed analysis (typical composition) 1.50C, 4.2 Cr, 2.5 Mo, 2.5 W, 4.0 V, normal amounts of Mn and Si, balance Fe and unavoidable impurities. The analysed composition is given in Table 1, steel No. 8. Also the typical compositions of a number of reference materials, steels Nos. 9–13, have been included in Table 1.

About 6 tons of powder were made of steel No. 8. The powder was filled in capsules, each containing about 1500 kg powder. The capsules were closed, gas evacuated, cold and hot isostatic compacted at a temperature of 1150° C. and a pressure of 100 MPa, forged, and rolled to the shape of rods, some of them all the way down to the dimension Ø about 6.2 mm. Test specimens were machined to the size Ø 6 mm. Equal test specimens also were made of steel No. 9.

The test specimens were hardened from different solution heat treatment temperatures, varying between 1000 and 1200° C., and tempered 3×1 h at 560° C. The results are given in FIG. 1, which shows that the substantially higher alloyed reference material No. 9 had the highest hardness but also that steel No. 8 of the invention achieved a hardness which is sufficient for the intended applications.

Figure 2:
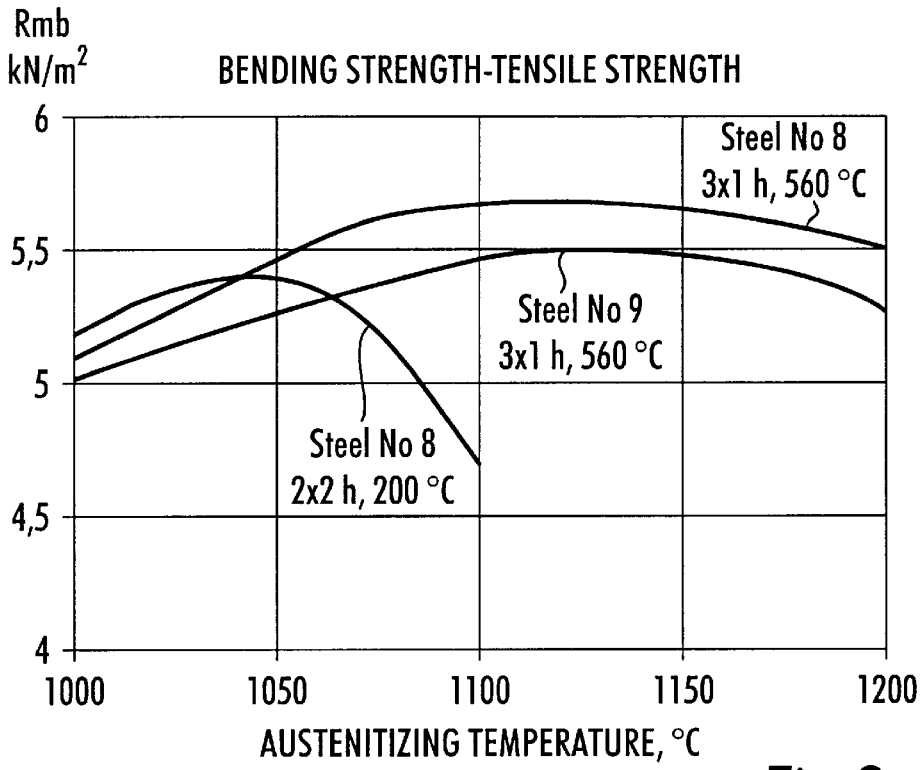
FIG. 2 shows the bending strength—tensile strength—versus the hardening temperature of the steel of the invention for two alternative tempering temperatures and also for a reference material.
Figure 3:
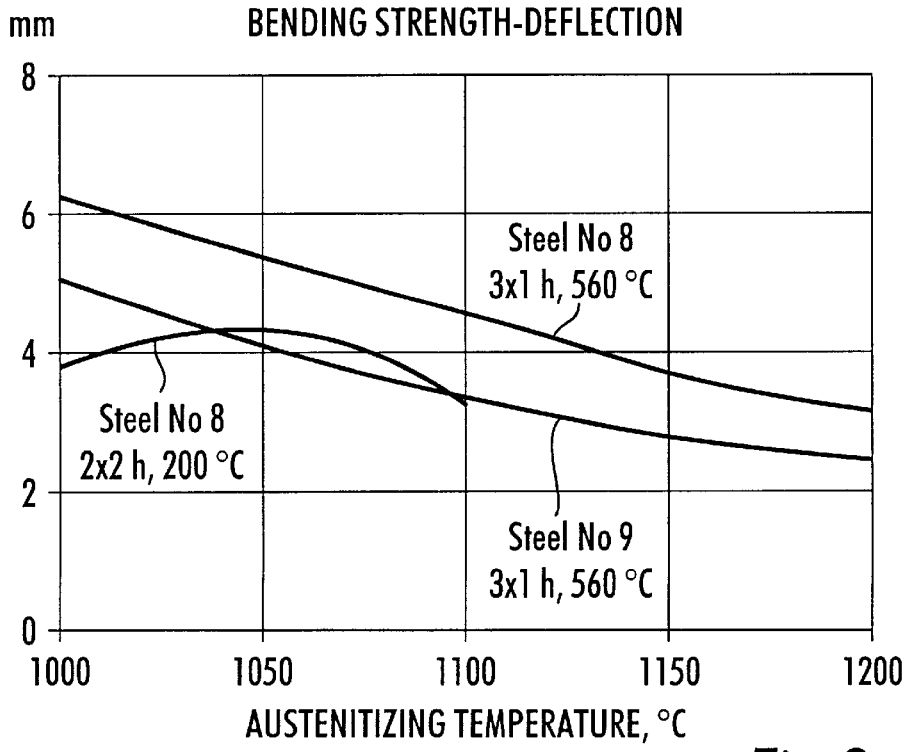
FIG. 3 shows the bending strength—deflection—versus the hardening temperature for the same materials and during the same conditions as for FIG. 2.

Thereafter the toughness was examined after different solution heat treatment temperatures for steel No. 8 of the invention after tempering on one hand at 560° C., 3×1 h, and on the other hand after tempering at 200° C., 2×2 h and for the reference material, steel No. 9, after the same tempering treatment as at the hardness test, i.e. at 560° C., 3×1 h. The toughness was measured in terms of bending strength/tensile strength and in terms of bending strength/deflection. The results are illustrated in FIG. 2 and FIG. 3. The bending strength tests show that the steel of the invention had the highest toughness regardless of solution heat treatment temperature. Further FIG. 2 shows that best toughness after solution heat treatment at temperatures between 1050 and 1200° C. and higher was achieved after high temperature tempering treatment, i.e. according to the example at 560° C., but that after solution at lower temperatures, 1000–1050° C., best toughness was achieved after tempering treatment within the lower temperature range, according to the example at 200° C.

The same tendency is illustrated also in FIG. 3, but it is here much more evident that by far the best toughness is achieved with the steel of the invention after the high temperature annealing treatment.

For wear resistance tests, test specimens were used, size Ø 15 mm. The tests were carried out according to the method which is known in the art as the "Pin on disc, dry $SiO_2$ flint paper"—test, grain size 150 mesh, load 20 N, 2 min. Also the steels which in Table 1 are denominated steel Nos. 11, 12, and 13 were tested besides steel No. 8 of the invention and the reference steel No. 9. Steel No. 11 was a powder-metallurgically manufactured cold work steel; steel No. 12 was a conventionally manufactured high speed steel, type M2; and steel No. 13 was a conventional cold work steel, type D2. The hardnesses are given in FIG. 4. Steel No. 8 of the invention was tested on one hand after high temperature tempering at 560° C. and on the other hand after low temperature tempering at 200° C.

Figure 4:
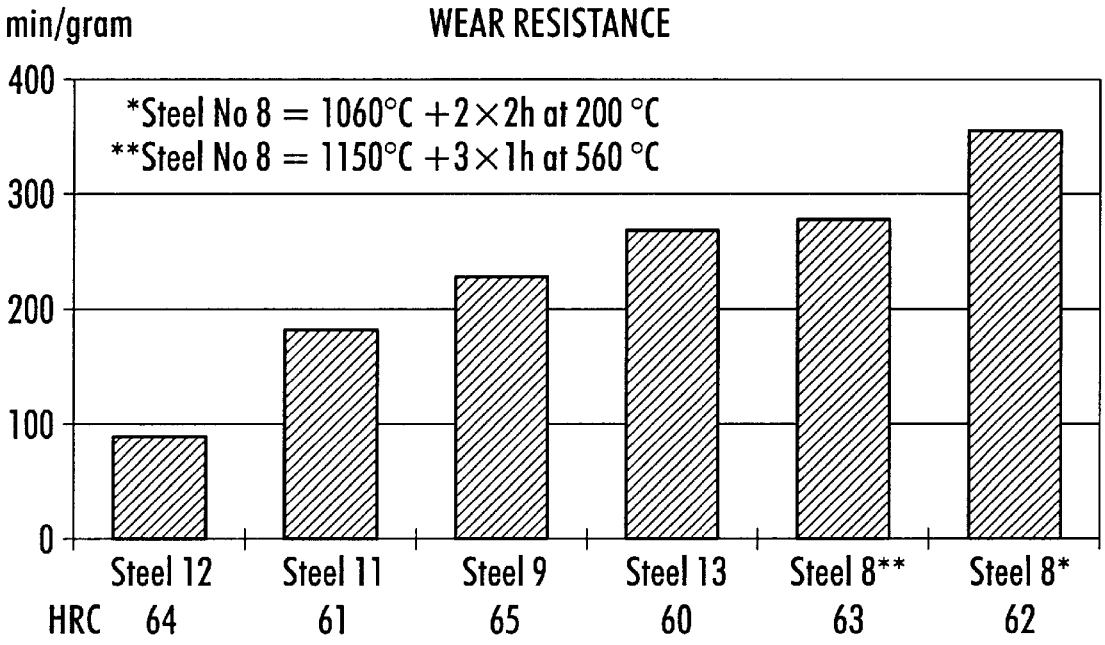
FIG. 4 shows the wear resistance of a number of examined steels.

As far as the interpretation of the bar chart in FIG. 4 is concerned, the wear resistance is proportional to the height of the bar. Best result was achieved for steel No. 8 after hardening from 1060° C. and tempering 2×2 h at 200° C., and next best was steel No. 8 of the invention when hardened from 1150° C. and tempered 3×1 h at 560° C. Equal wear resistance had the cold work steel No. 13, which is a conventionally manufactured high chromium steel with a high amount of large chromium carbides which promote the wear resistance but which on the other hand impair other important features, particularly the toughness.

Figure 5:
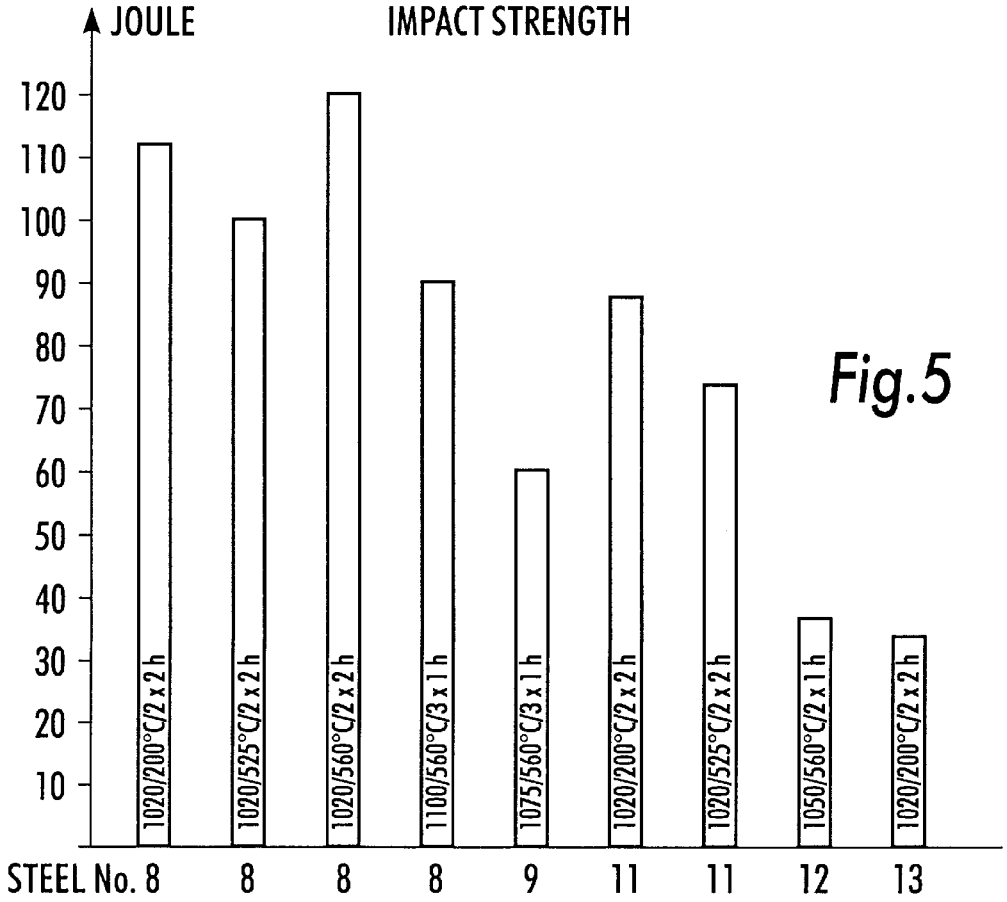
FIG. 5 shows the toughness in terms of impact strength for a number of tested steels.

Then the impact strength according to the VW-method (Volkswagen), specimen size 7×10×55 mm, was investigated for steel Nos. 8–13. The applied heat treatments and achieved results are given in Table 3. The results are also illustrated in FIG. 5, which shows that steel No. 8 of the invention had the by far best toughness results in terms of impact strength among the tested steels.

TABLE 3

Impact strength tests, VW-method

| Steel No. | Austenitising temperature, ° C. | Tempering temperature, ° C., number of tempering operations, and duration | Hardness, HRC | Impact Strength, Joule |
|---|---|---|---|---|
| 8 | 1020 | 200, 2 × 2 h | 61,8 | 111 |
| 8 | 1020 | 525, 2 × 2 h | 60,5 | 100 |
| 8 | 1020 | 560, 2 × 1 h | 58,7 | 120 |
| 8 | 1100 | 560, 3 × 1 h | 61,3 | 90 |
| 9 | 1075 | 560, 3 × 1 h | 61,1 | 61 |
| 11 | 1020 | 200, 2 × 2 h | 59,7 | 88 |
| 11 | 1020 | 525, 2 × 2 h | 58,2 | 74 |
| 12 | 1050 | 560, 2 × 1 h | 57,7 | 36 |
| 13 | 1020 | 200, 2 × 2 h | 59,4 | 34 |

Figure 6:
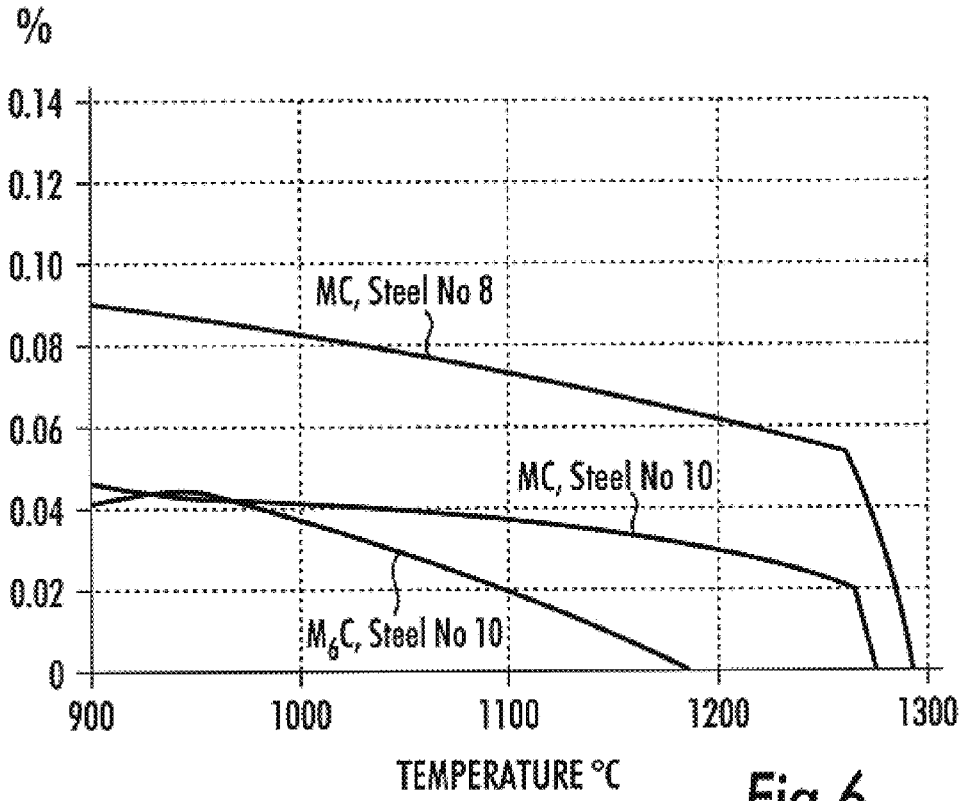
FIG. 6 illustrates the content of MC-carbides in a steel of the invention and the content of MC-carbides and $M_6C$-carbides in an other material after tempering at different solution heat treatment temperatures.

Finally also the carbide content in the steel of the invention was examined after cooling from different solution heat treatment temperatures. As a reference also the carbide content in a known valve steel—steel No. 10 in Table 1—was determined, the said steel having a lower carbon content and somewhat lower vanadium content than the steel of the invention. The total amount of molybdenum and tungsten, expressed as $W_{eq}$, corresponded with what can be tolerated at a maximum according to the broadest $W_{eq}$ range according to the invention. The study showed, FIG. 6, that only MC-carbides could be detected in the steel of the invention, more particularly between 5 and 10% within the entire tested temperature range. Steel No. 10 contained less than 5% MC-carbides but also $M_6C$-carbides after hardening from temperatures up to at least about 1150° C.

Figure 7:
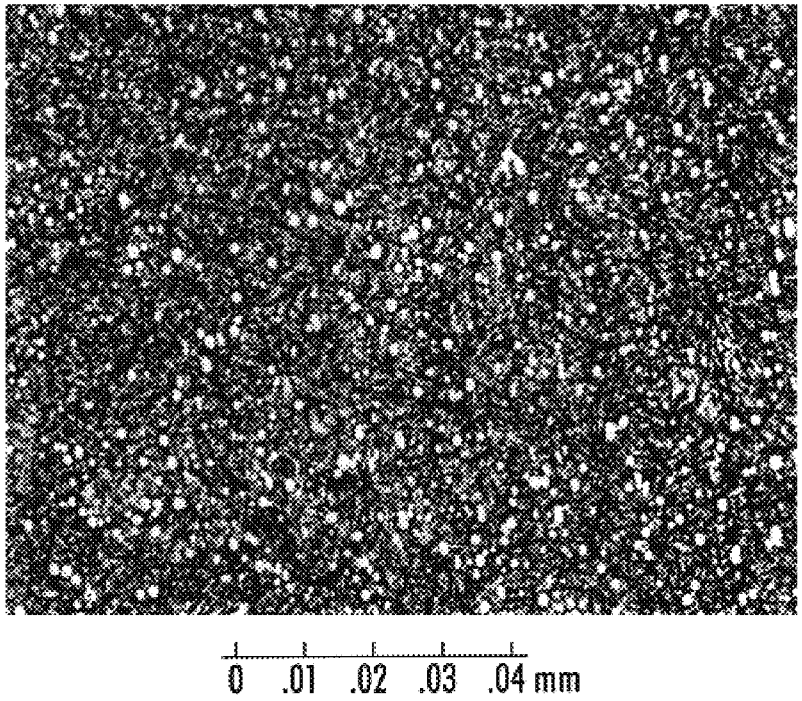
FIG. 7 shows the micro-structure of a steel of the invention after heat treatment.

FIG. 7 shows the micro-structure of steel No. 8 of the invention after hardening from 1100° C., tempering 3×1 h, 560° C. The bright, round or more or less oval particles consist of undissolved MC-carbides. The matrix consists of tempered martensite. Secondarily precipitated $M_2C$-carbides, which exist in a large amount in the martensitic matrix are not visible at the actual magnification because of their smallness; sizes in the order 5 a 10 nm.

Figure 8:
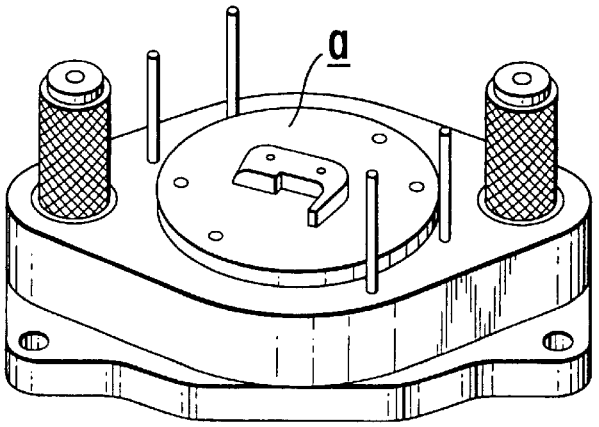
FIG. 8 shows a typical tool for which the steel of the invention can be used.

In FIG. 8 there is shown a tool, an upper-die a, intended to form part of a punching tool for which the steel of the invention advantageously can be used.

What is claimed is:

1. A powder-metallurgically manufactured steel alloy for tools for forming and/or cutting operations, the alloy comprising in weight-%:

1.4–1.6 (C+N);

max. 0.6 Mn;

max. 1.2 Si;

3.5–4.3 Cr;

1.5–3 Mo;

1.5–3 W, wherein $6<W_{eq}<9$, and $W_{eq}$=% W+2×% Mo;

3.5–4.5 V;

max. 0.3 S;

max. 0.3 Cu;

max. 1 Co; and a total amount of max. 1.0 of Nb+Ta+Ti+Zr+Al, balance essentially only iron, impurities and accessory elements in normal amounts.

2. The steel alloy of claim 1, comprising at least 1.44 and at most 1.56 (C+N).

3. The steel alloy of claim 1 wherein 40–60% of C and N exist in undissolved hard products of MX-type, which means primary carbides or carbo-nitrides, where M is V and X is C and/or N.

4. The steel alloy of claim 1, comprising max. 0.03 S.

5. The steel alloy of claim 1, comprising 0.1–0.3 S.

6. The steel alloy of claim 1, comprising 3.8–4.2 Cr.

7. The steel alloy of claim 1, wherein $6.5 \leqq W_{eq} \leqq 8.5$.

8. The steel alloy of claim 1, comprising 3.8–4.2 V.

9. A tool made of the steel alloy having a composition of claim 1, the tool material having a micro-structure substantially consisting of a martensitic matrix and in the matrix 2–15 volume-% of undissolved hard products having the particle size 0.1 –3 μm, said hard products being of MX-type, where M is V and X is C and/or N, wherein 40–60% of the C and N content of the alloy is bound to vanadium as carbides and/or as carbo-nitrides, and a functional amount of hard products precipitated in the martensitic matrix after solution heat treatment of the steel at a temperature between 1000 and 1225° C. and tempering at least twice for at least 0.5 h at a temperature between 190 and 580° C.

10. The tool according to claim 9, wherein the martensitic matrix contains a functional amount of hard products of $M_2X$-type, where M is metals belonging to the group consisting of Cr, Mo, W, V, and Fe, and X is C and N, said hard products having a size smaller than 100 nm, obtainable by tempering the steel at a temperature between 520 and 570° C.

11. The tool according to claim 9, wherein the tool material contains a functional amount of hard products of $M_3X$-type, where M substantially is Fe and Cr, and X is C and/or N, obtainable by tempering the steel at a temperature between 190 and 250° C. after solution heat treatment at a temperature between 1000 and 1100° C.

12. The tool according to claim 9, wherein tool material has a hardness of at least 62 HRC and a bending strength of at least 5.5 kN/mm$^2$ after hardening from a temperature between 1100 and 1200° C. and tempering at a temperature between 520 and 570° C.

13. An integrated process for the manufacturing of a steel and a tool thereof, comprising the following steps:

preparing a steel melt having the alloy composition of claim 1;

forming droplets of the melt, and cooling the droplets to form a powder of said steel alloy, in which existing hard products of type MX, where M substantially is V, and X is C and/or N, consist of particles, in which at least 90% of the total amount of said hard products has a particle size between 0.1 and 3 μm;

densifying the powder to form a body with complete density through a densification process which comprises hot isostatic compaction;

hot working the body through forging and/or rolling;

soft annealing the forged and/or hot roll product;

making a tool with desired shape of the soft annealed product; and hardening the tool through solution heat treatment (austenitisation) at a temperature between 1000 and 1225° C., intensified cooling to below 500° C. and continued cooling to below 50° C., and tempering at a temperature between 190 and 580° C., such that the tool material will obtain a micro-structure substantially consisting of a martensitic matrix and in the matrix 2–15 volume-% of undissolved hard products having the particle size 0.1–3 μm, said hard products being of MX-type, where M is V and X is C and/or N, wherein 40–60% of the C and N content of the alloy is bound to vanadium as carbides and/or as carbo-nitrides, and a functional amount of hard products precipitated in the martensitic matrix after said solution heat treatment cooling and tempering of the steel.

14. The steel alloy of claim 7, wherein $7 \leqq W_{eq} \leqq 8$.

15. The tool of claim 9, in which the martensitic matrix of the tool material contains 5–10 volume-% of undissolved hard products having the particle size 0.1–3 $\mu$m, said hard products being of MX-type, where M is V, and X is C and/or N.

* * * * *